United States Patent [19]

Kramp et al.

[11] Patent Number: 4,660,470

[45] Date of Patent: Apr. 28, 1987

[54] INKING UNIT PRE-ADJUSTMENT METHOD

[75] Inventors: Jurgen Kramp, Offenbach am Main; Peter Schramm, Frankfurt; Gerhard Augsberg, Obertshausen; Gerd Steiner, Heusenstamm, all of Fed. Rep. of Germany

[73] Assignee: M.A.N.-Roland Druckmaschinen Aktiengesellschaft, Fed. Rep. of Germany

[21] Appl. No.: 663,227

[22] Filed: Oct. 22, 1984

[30] Foreign Application Priority Data

Oct. 20, 1983 [DE] Fed. Rep. of Germany ..... 3338143

[51] Int. Cl.[4] ..... B41F 31/04; B41F 31/10

[52] U.S. Cl. ..... 101/426; 101/365

[58] Field of Search ..... 101/132, 136, 137, 139, 101/140, 426, 141, 142, 143, 144, 145, 211, 365, 350, 352, 207–210

[56] References Cited

U.S. PATENT DOCUMENTS

| | | | |
|---|---|---|---|
| 2,283,003 | 3/1942 | Frostad et al. | 101/182 |
| 3,185,088 | 5/1965 | Norton | 101/365 X |
| 3,757,689 | 9/1971 | Koch et al. | 101/148 |
| 3,771,446 | 11/1973 | Kaneko et al. | 101/144 |
| 3,835,777 | 9/1974 | Krgeris | 101/365 |
| 3,908,545 | 9/1975 | Simeth | 101/350 |
| 3,965,819 | 6/1976 | Punater | 101/DIG. 6 |
| 3,978,788 | 9/1976 | Cappel et al. | 101/363 |
| 4,000,692 | 1/1977 | Wirz et al. | 101/144 |
| 4,084,508 | 4/1978 | Kaneko et al. | 101/142 |
| 4,200,932 | 4/1980 | Schramm et al. | 364/519 |
| 4,233,663 | 10/1980 | Sugawara et al. | 364/515 |
| 4,353,299 | 10/1982 | Murai et al. | 101/144 |
| 4,381,708 | 5/1983 | Hirt | 101/365 |

FOREIGN PATENT DOCUMENTS 1137597 12/1982 Canada .

OTHER PUBLICATIONS

"Heidelberg Offset CPC", published at Dupra, Jun. 3–16, 1977.

Laubscher, "A System for Reduction of Setting-Up Time and Idle Time of Rotary Offset Machines", *Der Polygraph* (MAVO) article) (10/22/75) pp. 1393–1400.

*Primary Examiner*—J. Reed Fisher

*Attorney, Agent, or Firm*—Leydig, Voit & Mayer

[57] ABSTRACT

As ink is conveyed through the inking unit of a printing machine, a state of equilibrium occurs which ensures adequate inking of the printing plate during continuous printing. The equilibrium state includes different ink gradients for the respective printing zones superimposed on a uniform base level. In order to achieve the state of equilibrium rapidly and easily at the start of printing, an ink distribution is produced in the inking unit before printing closely matching the state of equilibrium for continuous printing. An accurately defined ink film distribution is initially fed to the inking unit rollers via the vibrator. Preferably, when the ink applicator rollers are thrown off of the plate cylinder and the sheet feed is off, a predetermined amount of ink is introduced to the inking unit. The vibrator is then shut off and the base level of ink is allowed to become uniformly distributed. Next the ink profile is set at the ink metering elements and the vibrator is turned on. When the ink profile propagates to the applicator rollers, the applicator rollers are thrown on to the plate cylinder and the sheet feed is turned on.

18 Claims, 10 Drawing Figures

U
G3
GF
A

U
G2
GF
A

B
GF
G1
A

24
VIBRATOR
32
P
Z
W4
W3
W2
W1
12
13
11
D
PRINTING PLATE
V
X1
X2
X3

INKING UNIT PRE-ADJUSTMENT METHOD

BACKGROUND OF THE INVENTION

1. Field of the Invention

The invention relates to a method of adjusting the inking unit of a printing machine in response to values obtained by scanning or sensing the printing plate, the storage of a previous print order, or by scanning or sensing an original print.

2. Description of Related Arts

The printing process in a printing machine consists basically of conveying printing ink from a reservoir via an inking unit to a printing plate or forme and producing a print from this plate or forme on a printing support. In the case of offset printing, the printing plate also must be dampened and the print transferred from the printing plate to the printing support via a blanket. The printing support is generally paper in the form of sheets or web.

In offset printing there is the specific problem of having to use a printing ink of relatively high viscosity. This is a consequence of the fact that an adequate layer of ink has to be produced on the print support to give an optically adequate print, using very thin ink films. For this purpose, offset printing inks contain very highly concentrated colour pigments and if they are to be usable at all they have to be used in a very viscous state.

The high viscosity of the ink, however, affects the distribution of the ink in the inking unit. The inking unit must be specially constructed to accommodate the high viscosity. A complicated inking unit comprising numerous rollers is usually required to produce a very thin uniform film of ink as required in offset printing. The rollers are usually fed via a vibrator from a duct roller upon which a precise ink profile is set up by ink metering elements. However, the more complex the inking unit construction , the longer it takes before any adjustments made to the ink supply are visible in the print. Experience has shown that continuous printing requires some 300 prints before any adjustment of the ink metering elements reaches the paper and equilibrium is established in the ink transport by the inking unit. The optical impression of the print changes long before this. Dampening of the printing plates is also important in the case of offset printing.

To enable a printing machine to be operated for continuous printing, equilibrium must be established with respect to the ink transport process through the inking unit. Starting with an empty inking unit, for example one cleaned the previous day, a certain quantity of ink is initially required to ensure that all the inking unit rollers are coated with printing ink. This fairly rapidly establishes the ink flow required for continuous printing. In conventional vibrator type inking units, however, it would take a very considerable time to transport to the inking unit rollers the layer of ink required for filling, if it were done solely via the vibrator cycle. Basically, printing ink is needed in the inking unit even where no printing ink is taken from the printing plate during continuous printing.

An additional factor affecting establishing a condition of equilibrium in the inking unit is the "printing plate content" or ratio of printing and non-printing areas on the printing plate and where the printing and non-printing areas are situated. In the printing process, the distribution in the inking unit also builds up a film of ink at places where no printing areas are located on the printing plate.

The objective of the printer is to accelerate the establishment of the state of equilibrium for continuous printing, and typically a manual operation is performed to accelerate the initial distribution of ink particularly traversly of the printing unit. Spreader rollers are provided for this purpose in conventional inking units and are disposed above the first inking unit roller following the vibrator. After filling the duct with ink, the printer applies a strip of ink to the spreader roller, spreading the ink by means of a spatula. The printer will do this particularly where little or no ink is used, because the state of equilibrium is established there only very slowly. The printer then applies the spreader roller manually against the inking unit while the inking unit is running but while it is disconnected from the plate cylinder. The amount of ink applied to the spreader roller is thus distributed throughout the inking unit, where it forms a basic film of ink.

This basic film is, of course, undefined both in terms of thickness and gradient. It is precisely at those places where there is little ink supply that there is already an adequate or possibly even excessive film of ink present. This interferes with the ink feed particularly in the direction of ink transport. The transverse transport by spreading has little effect. The areas having little ink transport in continuous printing are saturated more quickly than would be possible by the normal ink feed.

After the manual spreading operation described above, the ink metering profile set up on the duct roller for the particular printing plate content is introduced to the prepared inking rollers by means of the vibrator. If the printer applied just a sufficient amount of ink during the spreading operation, the incoming ink metering profile is rapidly fed to the inking unit as required. But in practice the results depend basically on the printer's knowledge and experience. It is therefore a question of the printer's feeling for his machine that determines whether optimum results are quickly achieved in continuous printing. Distributing any quantity of ink via the inking unit simply be feel results in an undefinable condition from which the required equilibrium of the ink transport is slowly obtained.

German Offenlegungsschrift No. 2 922 964 corresponding to Canadian Pat. No. 1,137,597 describes a system of printing press preparation and control, in which the inking unit pre-adjustment is described as procedure 5000. This involves using known printing conditions to derive values for adjusting the inking unit of a printing machine. The parameters used are dampening unit settings, machine speed, duct roller rotation, vibrator cycle, plate cylinder and applicator roller diameter and printing plate surface coverage. The thickness of the film of ink required on the applicator roller, and depending thereon the position of the metering elements, are determined from these parameters. Basically, the printing ink itself is included as a parameter. A prerequisite for these calculations is that the inking unit should be in a stable condition, but this means that an adequate quantity of ink must first be present and distributed in the inking unit. The system described, however, can be used only to pre-determine the inking unit setting for the case of continuous printing. In conjunction with the objective of the system, a considerable quantity of spoils are quite deliberately included in the calculations, such spoils occurring during printing until the inking unit is in a state of equilibrium in terms of ink transport.

Control mechanisms have been known for some time in office offset printing machines to automate the sequence of operations of such machines. In these machines the printing plate or foil is automatically fed in, the inking unit and the dampening unit switched on, and the paper transport and printing are initiated. German Offenlegungsschrift No. 2 637 071 corresponding to U.S. Pat. No. 4,084,509 describes a control mechanism for an offset printing machine comprising a pawl and ratchet mechanism by means of which the sequence of operations is automated from the plate feed up to the printing of the first sheet of paper. The paper feed is delayed until the plate has been pre-dampened and has received sufficient ink via the printing unit to produce a saturated print on the blanket. Only then is the first sheet to be printed, and is said to give a good print immediately. However, this system requires a very short inking unit and a relatively low viscosity ink. In addition, the ink profile requirements in such printing machines are very low because they are of course used only for single-colour printing. This means that a uniform film of ink is required over the width of the inking unit, and can be produced easily and rapidly. Also important to the operation of an office offset machine is that there should be no need for further adjustment at the inking unit when the plate is inked and printing starts. The conditions for filling an inking unit of this kind are therefore different from those in offset printing machines which have larger inking units which store the ink. The control mechanism in question therefore uses a fixed transmission system which produces a constant sequence of operations. Since the transmission system is not adjustable, inking of the inking unit is the same for all applications and offers no facility of adapting the ink feed to special cases.

SUMMARY OF THE INVENTION

The primary object of the invention, therefore, is to develop a reliable method of quickly bringing an inking unit to a state of equilibrium suitable for continuous printing.

In accordance with the invention, as further described below, the inking unit is quickly brought to a state of equilibrium before printing starts by feeding an accurately defined ink film thickness distribution to the inking unit rollers by way of the vibrator before printing starts, the distribution being just sufficient to bring the inking unit as close as possible to the equilibrium state in continuous printing.

BRIEF DESCRIPTION OF THE DRAWINGS

Other objects and advantages of the invention will become apparent upon reading the attached detailed description and upon reference to the drawings in which.

Figure 1:
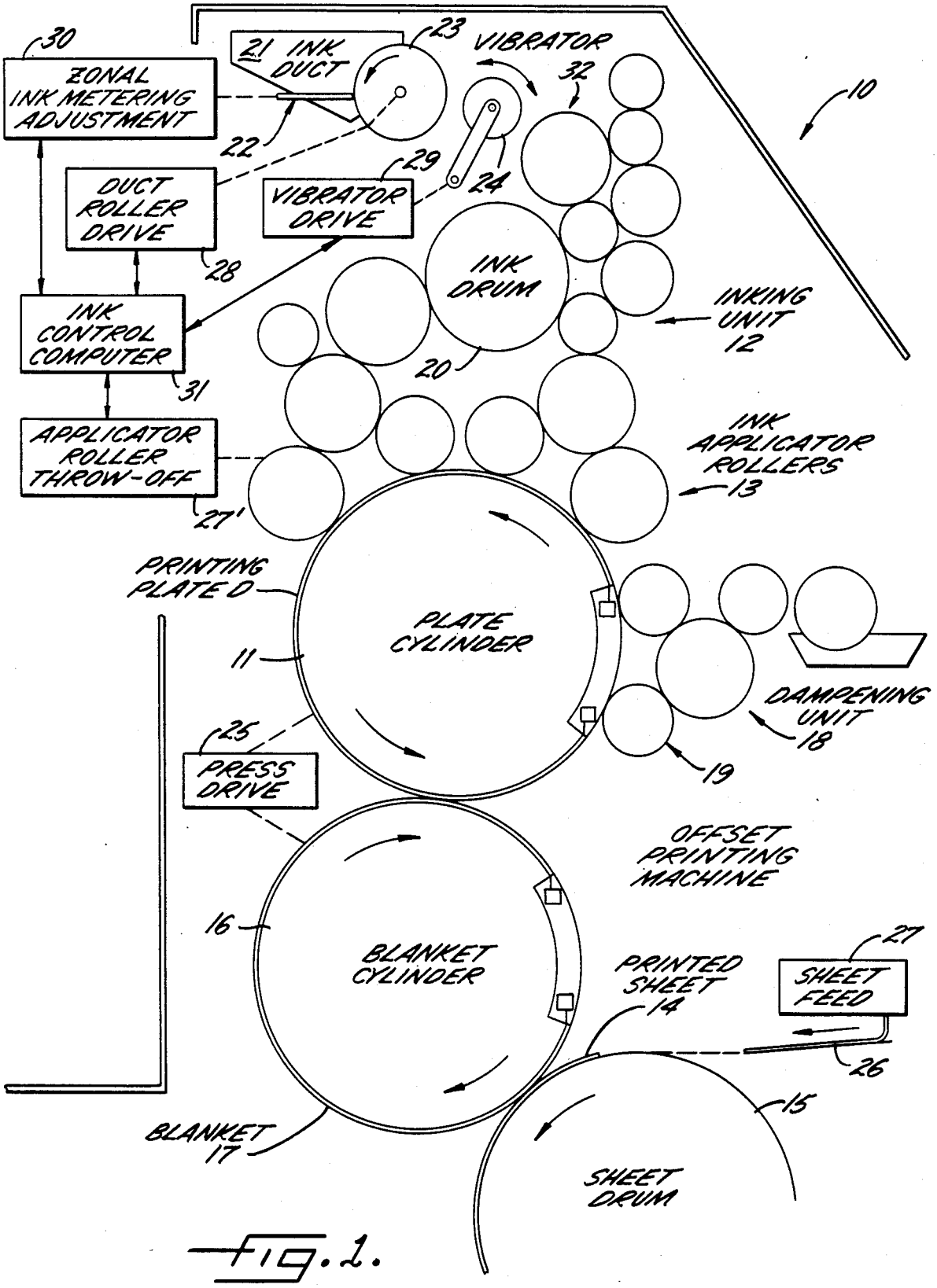
FIG. 1 is a schematic diagram of a commercial sheet-fed rotary offset printing machine suitable for multi-colour printing.

While the invention is susceptible to various modifications and alternative forms, a number of specific embodiments thereof have been shown by way of example in the drawings and will herein be described in detail. It should be understood, however, that they are not intended to limit the invention to the particular forms disclosed, but, on the contrary, the intention is to cover all modifications, equivalents, and alternatives falling within the spirit and scope of the invention as defined by the appended claims.

DESCRIPTION OF THE PREFERRED EMBODIMENT

Turning now to FIG. 1, there is shown a sheet-fed offset printing machine generally designated 10 of the kind used for multi-colour printing. The machine 10, for example, prints one of the primary colours. To carry out the printing process, the printing machine 10 includes a plate cylinder 11 carrying a printing plate D which is etched or engraved according to the information to be printed. An inking unit 12 has a number of applicator rollers 13 which apply ink to the printing plate D. According to the information or content of the printing plate D, ink is received from the ink applicator rollers 13 only at specific printing areas, and this ink is later transferred to a sheet 14 carried on a sheet drum 15.

In the offset method of printing, the printing plate D does not contact the sheet 14 carried by the sheet drum 15. Rather, the ink received by the printing areas of the printing plate D is first transferred to a blanket cylinder 16 carrying a rubber blanket 17. The ink received by the rubber blanket 17 is transferred by contact with the sheet 14. But in order for the ink received by the printing plate D to be easily transferred to the rubber blanket 17, the printing plate D must be dampened before ink is applied to the printing plate. Then the film of dampening fluid between the surface of the printing plate D and the applied ink film ensures that the ink is easily released from the printing plate D during the transfer of the ink to the blanket 17. For applying the dampening fluid to the printing plate D, a dampening unit 18 is provided including dampening applicator rollers 19 which engage the printing plate D on the plate cylinder 11.

It is especially important that the ink is applied in a precisely controlled fashion to the printing plate D. To ensure an acceptable print and particularly to assure proper colour balance for multi-colour printing, the density of ink must be zonally adjustable across the width of the printed sheet. Usually these zones correspond to columns of printed matter. To assure that the ink is uniformly distributed over these printing zones, the inking unit 12 includes numerous rollers. These rollers usually include an ink drum 20 to which a precisely defined film of ink is applied and from which ink is transferred to the numerous ink applicator rollers 13. To zonally adjust the ink density, a source of ink or ink duct 21 is provided with numerous zonal ink metering or adjustment devices 22. Typically the ink duct 21 includes a duct roller 23 and the zonal ink metering devices are flat slides defining a gap next to the surface of the duct roller 23, and the extent of the gap is adjusted to permit more or less ink to be applied to the surface of the duct roller. An ink duct of this kind is further described in Cappel et al. U.S. Pat. No. 3,978,788 issued Sept. 7, 1976. Typically the ink profile set up at the zones across the length of the duct roller 23 is introduced into the rollers of the inking unit 12 by a vibrator roller or ductor 24 which moves to and fro to successively pick up strips of ink from the duct roller 23 and introduce them to the successive rollers in the inking unit 12 leading to the ink applicator rollers 13. The operation of the vibrator 24 is further described in Simeth U.S. Pat. No. 3,908,545 issued Sept. 30, 1975.

In order to permit the inking unit to be set up before printing and to permit precise regulation of the density of ink applied to the printing plate D, the mechanical motions just described are typically controlled by a number of separate drives. For the machine 10 shown in FIG. 1, the series of rollers in the inking unit 12 such as the ink drum 20 as well as the plate cylinder 11, blanket cylinder 16, and sheet drum 15 are driven by a common press drive 25. So that the inking unit 12 can be set up before printing, the sheets 26 to be printed are supplied by a sheet feed 27 which can be turned off independent of the press drive 25. Also, when the sheets are not being fed or printed, it is desirable to throw off the applicator rollers 13, 19 from the printing plate D so that the applicator rollers do not develop flats. Typically pneumatic actuators or other means 27' are provided to throw off the applicator rollers in response to a control signal.

To permit the density of ink applied to the plate cylinder D to be adjusted during printing, the duct roller 23 and vibrator 24 are typically driven by separate and adjustable drives 28, 29 respectively. In addition, the ink metering elements 23 are typically adjustable by remote control devices 30. An ink control computer 31 is typically provided to control the vibrator drive 29, the duct roller drive 28, and the zonal ink metering devices 30 in response to the initial scanning of the printing plate D, the scanning of a corresponding print, or by using prestored values. Such computerized remote controls are sold by all of the major printing machine manufactures, and a suitable system is described, for example, in Schramm et al. U.S. Pat. No. 4,200,932 issued Apr. 29, 1980.

To enable the printing machine 10 to be operated for continuous printing, equilibrium must be established with respect to the ink transport process from the ink duct 21 and through the inking unit 12 to the ink applicator rollers 13 and the printing plate D. The state of equilibrium in continuous printing has various features:

1. There is a basic film of ink at all points of the inking unit having a corresponding place in a printing zone on the printing plate. This basic ink film is about 5 microns thick for example.

2. An ink gradient from one inking roller to the next through the inking unit is built up on this basic film. The gradient is produced when the various rollers of the inking unit convey the amount of ink required during inking of the plate. In all cases the necessary amount of printing ink has to be introduced into the inking unit as a function of the surface coverage or content of the printing plate in order to obtain an adequate print. The magnitude of the gradient is proportional to the ratio of printing area to total area.

3. Ink gradients of different sizes are also obtained transversely across the inking unit due to varying ink requirements transversely thereof which are satisfied when a corresponding ink profile is set up on the duct roller. Although these transverse ink gradients are rendered substantially uniform by material distribution they are not obviated. As a result, some ink is also introduced into areas in which no inking takes place at all on the plate. Thus the equilibrium ink film also requires ink on the applicator rollers in those zones which correspond to the non-printing areas.

4. There is a dampening medium distribution in the inking unit. In the light of experience, this dampening medium distribution has a great influence on the ink transfer.

The occurrence of the gradient in the ink film thickness in the inking unit will now be considered in greater detail. The gradient is a function of the amount of ink drawn off the printing plate and the extent to which the ink is split up between the individual rollers. If a considerable amount of ink is drawn off the printing plate, a greater gradient is obtained than if just a small amount of ink is drawn off. For example, if the printing area is fully covered, then ink is also drawn from the ink applicator rollers over the entire area. The ink drawn off must be continually replaced. For this reason, it is essential that there should be at least a basic film of ink on the ink applicator rollers before they contact the printing plate. Otherwise the printing areas are not adequately inked when the ink applicator rollers contact the printing plate. Moreover, this basic film thickness is relatively independent of the printing plate content. The same basic ink film thickness is required if, for example, 10% rather than 100% of the plate has a printing area. During plate inking, ink is drawn off over the entire surface in the latter case while in the former case only one-tenth of this amount of ink is drawn off. Thus a very much greater gradient in the ink film thickness through the inking unit is obtained in the latter case of 100% area coverage.

Figure 2:
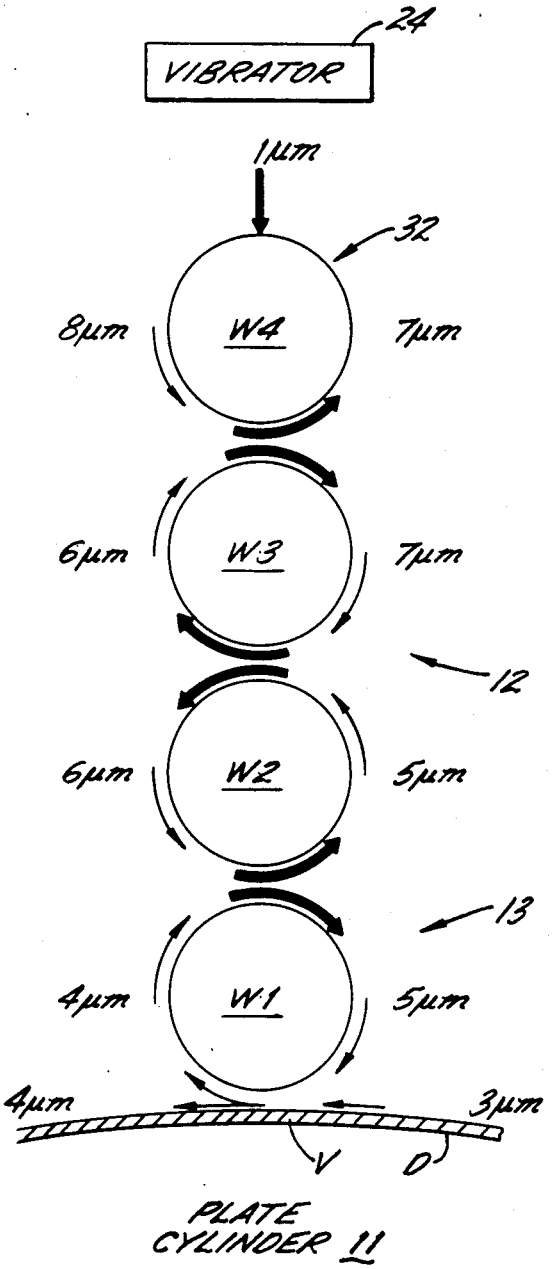
FIGS. 2 and 3 are simplified schematics of a side view of an inking unit showing two different respective ink film gradients.
Figure 3:
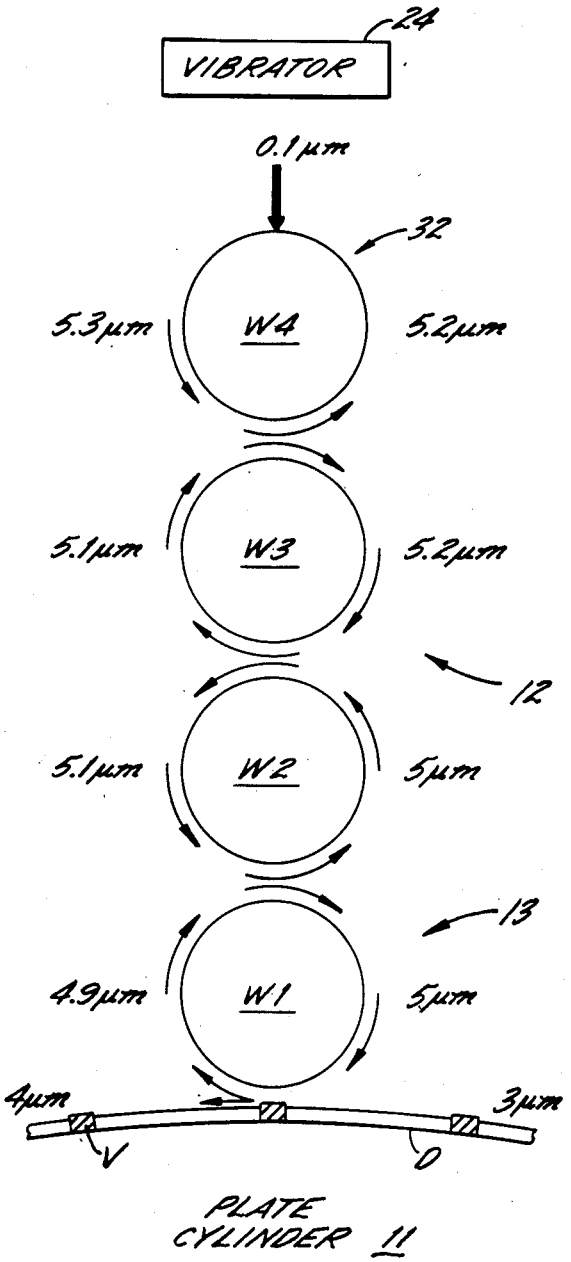

These conditions are shown in the simplified schematic diagrams of FIGS. 2 and 3, in which only four inking unit rollers W1, W2, W3 and W4 are shown. The rollers W1–W4 represent the numerous rollers in the inking unit 12 of FIG. 1. The roller W1 represents an applicator roller 13, and the roller W4 represents the roller 32 receiving ink from the vibrator roller 24. In FIG. 1 the inking unit 12 is represented at a printing zone where the printing plate D has a content or printing area distribution V corresponding to 100% surface coverage. In FIG. 2 the inking unit 12 is represented at a printing zone where the printing plate D is provided with a distribution V corresponding to 10% surface coverage.

The formation of the gradient of the ink film thickness in an inking unit will now be explained starting with FIG. 2. During continuous printing, this printing unit has a residual ink film thickness of 3 $\mu$m on the printing plate D after the print and a basic ink film thickness of 5 $\mu$m on the ink applicator roller W1.

The transfer of ink from one roller to the next in the inking unit follows certain ink splitting laws relating the respective ink film thicknesses on two engaging rollers after splitting to the respective ink film thicknesses on the rollers before contact of the respective films. In the simplest case, the respective ink films after splitting have equal thicknesses which is half of the sum of the thicknesses of the respective ink films before contact of the films. In other words, the ink is split in half.

Given a residual ink film thickness of 3 μm on the printing plate D and a basic ink film thickness of 5 μm on the roller W1, the simplified ink splitting law can be applied to determine the ink film thickness on all of the inking unit rollers W1–W4. Splitting between the applicator roller W1 and the plate D results in equal film thicknesses of 4 μm. The printing plate D takes its 4 μm film to the printing process while the roller W1 feeds its 4 μm film to the next splitting area between the rollers W1 and W2. Since it is already known that a film thickness of 5 μm is present on the roller W1 after this splitting area, a 5 μm film also forms on the roller W2 after the splitting area with the roller W1 in accordance with the simplified splitting law. The resulting total film thickness of 10 μm thus requires a feed of 6 μm on roller W2 to combine with the 4 μm of roller W1. Accordingly, a 7 μm ink film thic-kness is required on roller W3 before the splitting area for the purpose of splitting the ink between the rollers W2 and W3, and an 8 μm film thickness is required on roller W4 before the splitting between rollers W3 and W4. The difference of the film thickness on roller W4 before and after splitting gives an ink feed of 1 μm. Thus a gradient in the ink film thickness from 5 μm to 8 μm has formed through the inking unit 12 from the applicator roller W1 to the roller W4 as a result of the splitting and re-splitting.

FIG. 3 illustrates the feed of a small quantity of ink to the inking rollers W1–W4. In this case, printing ink is taken up on the plate D by only 10% of the surface corresponding to the distribution V of printing area. However, the same ink film thickness of 5 μm as in the case of 100% surface coverage is required at the printing areas V. Starting with a residual ink film of 3 μm on the printing plate D and 5 μm basic ink film on roller W1 before it is contacted, the total ink film thickness is 8 μm. It splits up so that there is a 4 μm thickness on the printing areas V of the printing plate while on average there is still 4.9 μm on the roller W1 after the splitting zone, because printing ink corresponding to 0.1 μm thick film thickness was taken off from only 10% of the total surface. The simplified splitting law applies to splitting between the applicator roller W1 and the printing areas V on the printing plate D but there is no transfer of ink between the applicator roller W1 and the non-printing areas of the printing plate D. Therefore, the net ink thickness is (10%)(4 μm)+(90%)(5 μm)=4.9 μm.

In order to obtain the basic film thickness of 5 μm after the splitting area between the rollers W1 and W2, an additional 5.1 μm film must be fed to the 4.9 μm ink film on the roller W1, via the roller W2. Accordingly, 5.2 μm is required on roller W3 and 5.3 μm on roller W4, before the corresponding splitting area in each case, in order to supply the necessary quantity of printing ink.

The difference in the ink film thicknesses on the roller W4 before and after splitting is made up by supplying a 0.1 μm film thickness of ink to the roller W4. Here a gradient of 5 μm on the roller W1 to 5.3 μm on the roller W4 has resulted corresponding to one-tenth of the gradient in the previous case of 100% surface coverage of plate D. In general, as the ratio of printing to total area on the printing plate D changes, the basic film thickness on the applicator roller W1 is substantially constant and the gradient is proportional to the ratio of printing to total area.

Figures 4, 5A, 5B, 5C:
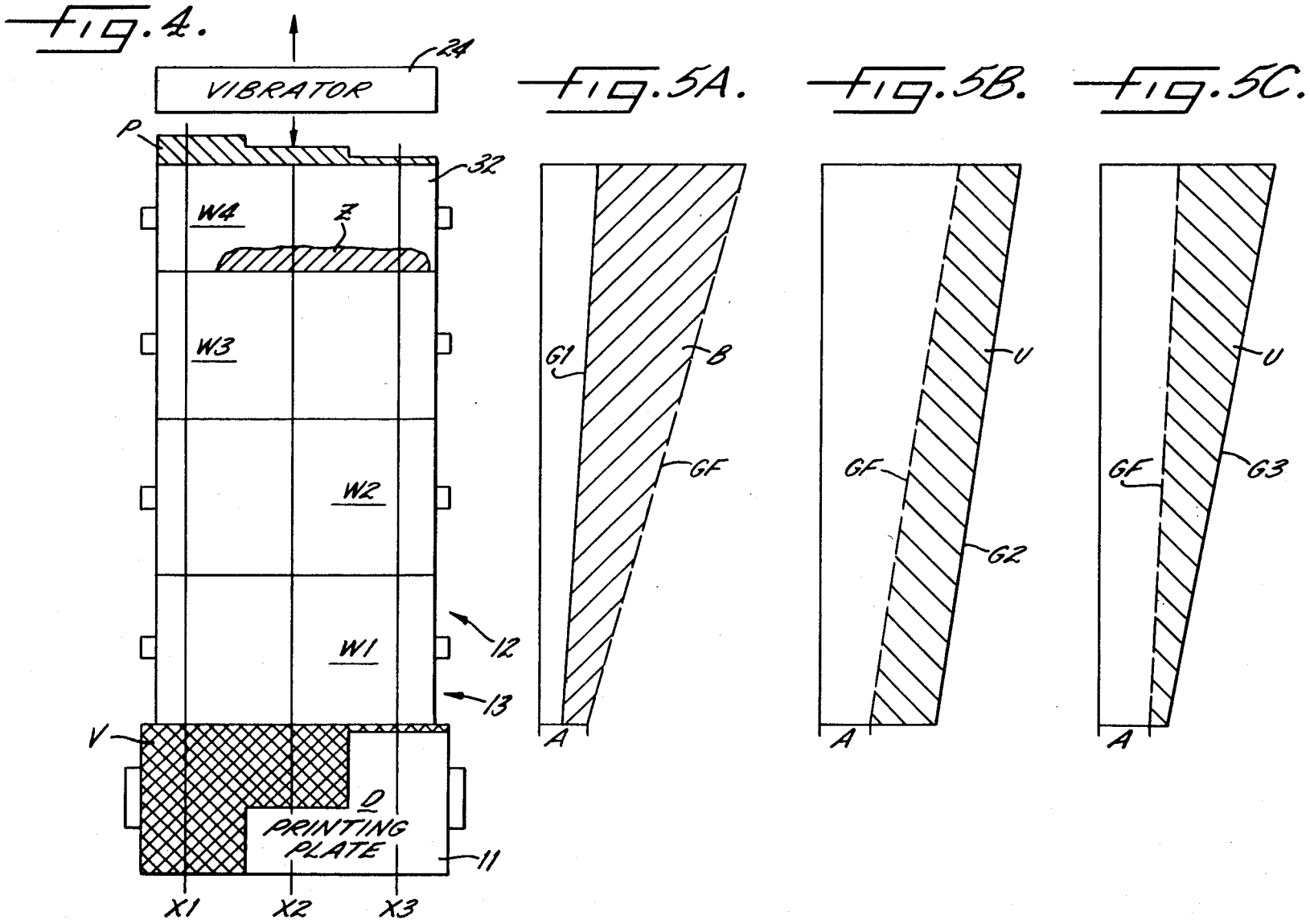
FIG. 4 is a schematic illustration in front view of the inking unit of FIGS. 2 and 3 and shows the ink profile and printing plate content across the inking unit.
FIGS. 5A, 5B and 5C are diagrams showing the ink film thickness gradient along the respective section lines X1, X2 and X3 of FIG. 4.

The respective conditions illustrated in FIGS. 2 and 3 are in each case a state of equilibrium which corresponds to the gradient in continuous printing. In the diagrams of FIGS. 4 and 5 the gradient GF is shown in broken lines while in FIG. 6 a solid line represents the gradient GF actually produced in the linking unit. The width of the diagrams in the horizontal direction represents the ink film thickness, the vertical direction indicates the position in the direction of ink transport through the inking unit, and the gradients are shown as compensatory straight lines.

The inertia of the inking unit affects the structure of these gradients and the transport of variations in ink metering. The larger an inking unit is in terms of roller area, the more sluggish its reaction is to adjustments in the amount of ink to be transported. The inertia increases when the total quantity of transported ink is reduced.

In view of these considerations, the inventors recognized that to save time for continuous printing, the inking unit should be brought as close as possible to the continuous printing condition beforehand. For this purpose the basic ink film thickness must be available on the applicator rollers and the gradients should be obtained as quickly as possible. This is especially true when the inking unit has a large storage effect. It is only necessary to introduce the basic film into the unit once and this applies when the inking unit is completely free of ink. However, the ink gradients must be introduced into the inking unit basically before each start-up of the printing machine, because the gradients always collapse when the printing process is interrupted.

According to several embodiments of the invention, the continuous printing gradient is approximately obtained at different times before the start of the printing operation for the respective embodiments. In one simplified version of the method of pre-adjusting the inking unit, the objective is to achieve a film of ink of uniform thickness transversely of the direction of transport in the inking unit as quickly as possible. The printing ink is supplied by the vibrator on the basis of uniform adjustment of the ink metering elements. In this case any lack of uniformity in introducing a quantity of ink determined by feel is eliminated. On supplying the ink in accordance with this step, an ink film thickness gradient occurs in the direction of transport through the inking unit rollers. This gradient is important to the subsequent formation of the continuous printing gradient and is therefore quite deliberately accepted. Deliberate control of the running-in operation enables the gradient to develop in such a manner that the continuous printing gradient can be obtained as quickly as possible. This gradient is advantageously so formed as to correspond approximately to the average of the gradients occurring during continuous printing at the printing zones across the inking unit. At some zones, depending upon the continuous printing state, there will be too little ink at some zones and too much at others. But equilibrium in all zones can develop fairly quickly according to the continuous printing conditions and thus provide good prints at an early stage. This procedure relieves the printer of the responsibility of bringing the inking unit into a defined starting condition for continuous printing and the entire sequence can thus be carried out in parallel with other jobs as a result of automation. The time required for filling the inking unit is thus eliminated and is fully available to the printer for other work, for example for the continuous printing or re-adjusting the ink profile.

Good prints can be obtained more rapidly with a refined version of the pre-adjusting method. The basic step is the same as the simplified method, the basic quantity of printing ink being introduced into the inking unit. In a second step the resulting gradient is eliminated by a uniformizing process in which the inking unit is run without any ink supply or discharge for a predetermined time period. The resulting basic ink film then corresponds to the amount of ink required on the ink applicator rollers for continuous printing. The ink distribution exponentially approaches a state of equilibrium that is substantially reached after the predetermined time period. The time period is proportional to the initial deviation of the distribution from the desired uniform distribution. While the ink film is being rendered uniform, the ink profile is set up on the duct roller according to the ink requirements or ratio of printing area to total area across the width of the printing plate. In a third step, the ink profile is then superimposed on the basic film in another running-in phase. By introducing the ink profile into the inking unit, the process of forming the continuous printing equilibrium is concluded substantially completely just before the start of printing. The actual printing operation then follows smoothly and the optimum continuous printing condition is achieved very rapidly, with only minor adjustments in ink metering being performed after the start of printing.

The use of this refined method is particularly advantageous when the inking unit is automatically adjusted in response to a device for scanning or sensing the printing plate or some other original for printing, for the purpose of determining the required ink profile adjustment to the ink metering elements during continuous printing. Then the printing machine can be brought rapidly and reliably into a continuous printing state giving good printing results. After the start of continuous printing there is no need to wait until the basic quantity of ink has entered the inking unit and the ink gradient required for the printing operation has built up.

A further improvement is possible by considering the dampening medium distribution in the inking unit. The distribution of the printing ink and the distribution of the dampening medium are in opposition to one another. There may be too little dampening medium in the ink or alternatively too much. The ink distribution must be so modified as to compensate for the dampening medium distribution in the inking unit. The adjustment required for the control system, both for the initial amount of ink transported into the printer unit, and for the later modification of the ink distribution to compensate for dampening, must be obtained from empirical values. It can be obtained by simple experiment for a specific printing plate and recorded in a control adjustment table in non-volatile memory. In this way it is possible to predetermine the ink quantity and time for automated running-in and adjustment of the gradient in response to the scanning or sensing of an original, depending upon the type of plate, printing ink and plate contents.

More specific steps for carrying out the simplified method and the refined method will now be described in connection with FIGS. 4–7. In FIG. 4 the associated printing plate D has the surface coverage distribution V defining the printing areas as shown at the bottom edge of the inking unit 12. Consider first how the printer initially fills the inking unit in accordance with the manual prior-art method of pre-adjustment prior to continuous printing. In accordance with this distribution V, the printer sets the metering elements 22 against the duct roller 23 (see FIG. 1). Consequently, a rough ink film thickness profile P is obtained on the roller W4 of the inking unit 12 (corresponding to roller 32 in FIG. 1). In order to fill the inking unit more rapidly, the printer now manually applies an estimated quantity of ink, for example, to roller W4, so that an additional film Z of the printing ink passes to the inking unit. The machine-fed profile P is partially superimposed on the film Z. This ink feed initially results in ink film thickness gradients along the rollers W1-W4, these gradients differing transversely of the inking unit, as shown in FIGS. 5A to 5C. FIG. 5A shows the gradient at the zone of the line X1 in FIG. 4, where there is a high surface coverage on the printing plate D and accordingly an increased ink supply in accordance with the profile P. After some machine revolutions this ink becomes distributed into the gradient G1 shown in FIG. 5A. The broken lines illustrate the gradient GF required for continuous printing, superimposed on the basic ink film A. The area between G1 and GF is hatched and represents the ink requirement B which has to be fed to the inking unit 12 before it is in equilibrium. In every case the basic film A must be available on the roller W1, which is an ink applicator roller 13. FIG. 5B shows the gradient G2 in the zone of the line X2 in FIG. 4. The gradient G2 is made up of one component corresponding to the profile P and another component made up of the additional ink film Z. The latter is regarded as being uniform in thickness, but this is not in keeping with reality. There is an ink excess V indicated by the hatched area, as compared with the continuous printing gradient GF. Here again the basic film A has to be produced, but in this case by the excess printing ink being received by the printing plate D and carried off by the printing process. Finally, FIG. 5C shows the gradient G3 in the zone of the line X3 in FIG. 4. Here ink is introduced into the inking unit practically only via the additional film Z. The total gradient G3 is above the very low-lying continuous printing gradient GF. This means that ink must first be eliminated during continuous printing.

A comparison of these three diagrams shows that the deviations of the ink film thickness from the state of equilibrium required in continuous printing are in some cases fairly considerable and depend to a high degree on the printer's skill. Superimpositions and opposed processes occur in the ink flow inside the inking unit. To compensate for this, in accordance with an important aspect of the invention, the printing ink is introduced into the inking unit controllably.

First, as a preparatory step, the surface coverage distribution V on the plate D is measured by a conventional method. The plate or prior print is optically scanned, for example, or stored values are obtained from the ink metering element adjustments used in previous continuous printing operations. In any event, the measured values correspond to the zonal adjustments for the ink metering elements 22 (FIG. 1), and the values are transferred to the inking control unit 31. When the printing plate D has been clamped in the printing machine 10, printing ink is introduced into the inking unit 12.

According to one specific method of the invention, the transport of the ink from the duct 21 to the inking unit 12 then takes place as follows: First of all, all the ink zones are given the same ink film thickness by way of their corresponding ink metering elements 22. In other words, the elements are all moved to the same distance from the duct roller 23. The speed of the duct roller is then set to a predetermined value. The vibrator 24 is moved to and fro between the duct roller 23 and the associated inking unit roller 32 in a constant cycle of one vibrator movement to two machine revolutions. Thus for a given speed of the machine the vibrator is always set against the duct roller for the same length of time. If the duct roller rotates more quickly, however, the transferred ink strip on the vibrator is wider. The vibrator strip required for filling the inking unit is obtained from empirical vlaues and measurements of the amount of ink contained in the inking unit. Once the duct roller speed has been set to a predetermined value, the vibrator is switched on for a given number of vibrator cycles so that a given quantity of printing ink is transported into the inking unit. It has been found empirically that an adequate basic quantity of ink is transported into the inking unit with about 10 vibrator cycles and approximately 25 mm wide vibrator strips with about 60% open ink metering elements. This film of ink is then uniformly distributed over the width of the inking unit 12, but has a gradient from the duct roller 23 and through the inking unit to the ink applicator rollers 13.

Once the basic quantity of ink is available in the inking unit 12, the ink metering elements 22 are adjusted to obtain the desired continuous printing ink profile across the width of the inking unit. The previously obtained values for the printing area distribution V at the printing plate D are converted to respective ink metering element positions. Once all the metering elements have been adjusted, the machine can be started. After this some time is required, even in normal operation, until the equilibrium in the inking unit has adjusted substantially to the ink profile produced.

Figure 6:
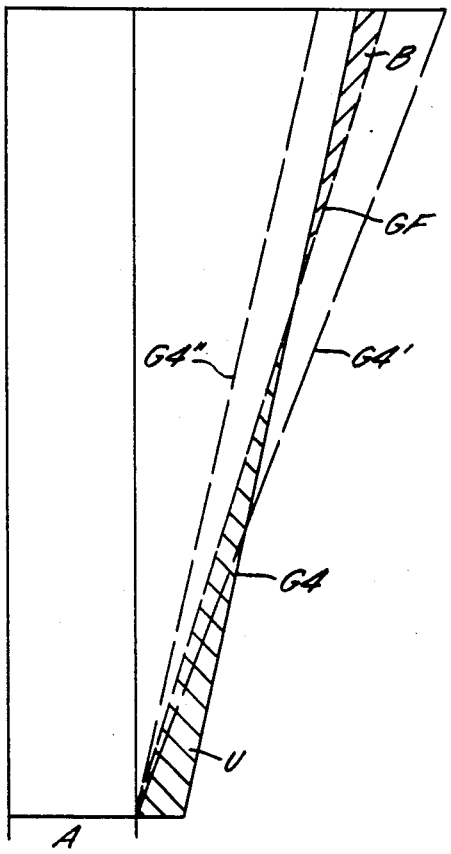
FIGS. 6 and 7 are diagrams showing the ink film thickness gradient according to specific embodiments of the pre-adjustment method of the invention.

FIG. 6 is a diagram showing the gradient in the film thickness for the specific procedure just described, corresponding to the simplified method of the invention introduced above. Only an average value of ink thickness is shown here. The basic quantity of ink is distributed in the inking unit along the gradient G4 as a result of the filling operation. This gradient G4, however, deviates from the gradient required for the state of equilibrium in continuous printing. The gradient G4 is equivalent to an averaging across the total inking unit width. It represents an average of all the different continuous printing gradients GF for the individual ink zones. The ink excess U and the ink requirement B are shown respectively in the hatched areas. In the spoils stage, the transition from the preadjustment gradient G4 to the continuous printing gradient GF proceeds relatively rapidly. It is clearly apparent that the difference in the ink flow is less and hence adaptation simpler than in the case of manual operation.

Figure 7:
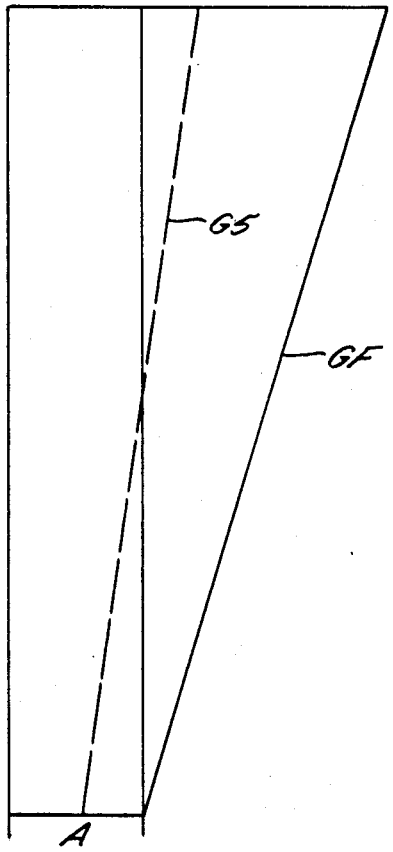

The gradient G4 can also be so adjusted that the basic ink film A is just obtained across the ink applicator rollers 13 over all of the inking zones. In this case, the resulting gradients G4', G4'' are different for the various inking zones. The ink filling step involves zonal compensation for ink excess or ink requirement as compared with the continuous printing gradient GF in the spoils stage through the inking unit 12, while at a middle position, as shown in FIG. 7, there is already an ink reserve available for forming the continuous printing gradient GF.

After this zonally-compensated ink filling step it is possible to assess whether the adjusted ink profile P is in keeping with the client's or printer's requirements with respect to the print. Manual corrections are carried out during printing following this running-in process. The ink profile P in the inking unit is thus produced in a defined manner and is carried out independently of the printer's "feel" except for a few corrections to allow for personal taste. The advantage of the method lies not only in that it reduces spoils and results in a saving in time, but also in the fact that the ink running-in process is independent of the printer and his care.

In the refined variant of the method previously introduced above, the gradient GF is produced even more accurately. To this end in a first step a given quantity of ink is transported into the inking unit 12 by turning on the drives 28, 29 to the duct roller 23 and vibrator 24 for a predetermined running-in time and with the duct roller speed and number of vibrator cycles adjusted to predetermined values. To ensure that the basic ink film A is still available everywhere in the inking unit 12, a second step to render the inking uniform is then performed with the vibrator switched off and the inking unit being run for a certain time without any ink being discharged. After this stage, it can be assumed that the ink is distributed throughout the inking unit to form the basic film A of uniform thickness. This film A of a thickness of about 5 $\mu$m is required on the applicator rollers in all cases. In a third step, the profile P is then adjusted at the ink metering elements 22 in accordance with the printing area or the surface coverage distribution V for the printing plate D. Then in a fourth step, another running-stage is performed. The duct roller drive 28 and the vibrator drive 29 are turned on for a predetermined running-in time to transport the ink into the inking unit 12 in accordance with the profile P and with a predetermined roller speed, and a predetermined number of vibrator cycles. The running-in time is selected so that the effect of the ink profile propagates to the applicator rollers, thereby setting up the continuous printing gradient GF between the duct 21 and through the inking unit 12 to the ink applicator rollers 13. When this is the case, the transition to the printing operation is carried out smoothly.

Figure 8:
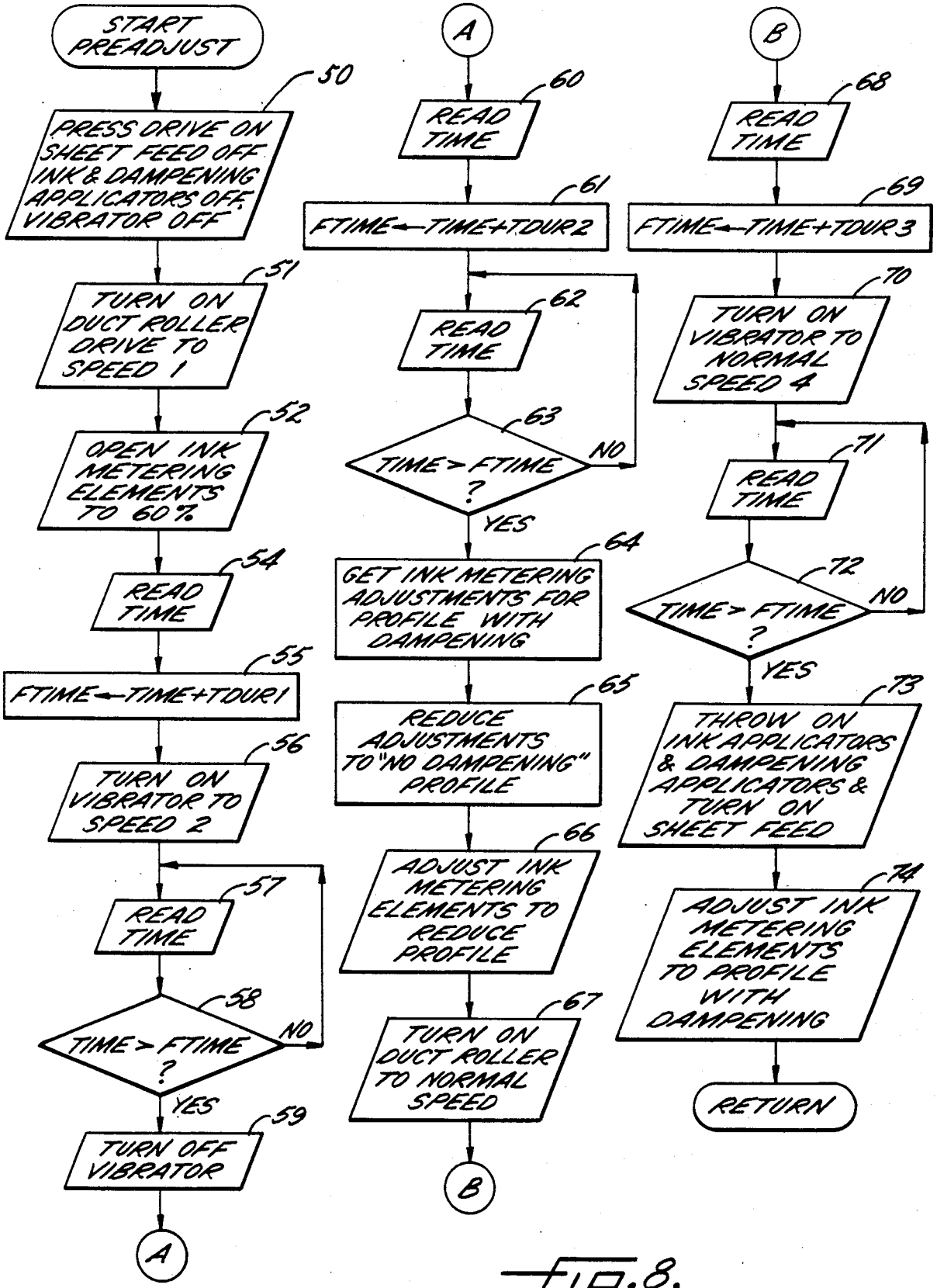
FIG. 8 is a flowchart of a control procedure executed by a computer for carrying out a refined embodiment of the invention.

FIG. 8 shows the structure of the continuous printing gradient GF after this procedure. The basic ink film A is produced from gradient G5 during uniformization in the second step. It is then present in the entire inking unit. In the running-in phase of the fourth step, there is fed to the inking unit the quantity of ink from which the continuous printing gradient GF is produced The machine is then ready for printing and immediately gives good sheets because equilibrium has been established in the inking unit. The time between introducing the ink profile P and the occurrence of the ink gradient GF and final equilibrium for continuous printing is saved in this case. Thus a certain quantity of spoils are also eliminated, which would have to printed even using the simplified pre-adjustment method.

The method of the present invention can take into consideration and compensate for the effect of dampening medium being conveyed from the printing plate D to the inking unit 12 when the applicator rollers 13 are thrown on to the printing plate and continuous printing occurs. Due to the influx of dampening medium, the ink profile P should be adjusted to compensate for the influx. In zones in which there is relatively considerable dampening medium, the ink supply must basically be increased since inking is obstructed in such areas by the dampening medium in the ink. This dampening medium distribution in the inking unit is dependent upon the printing plate content, since of course a relatively considerable amount of dampening medium is conveyed from the printing plate to the inking unit in areas which are only lightly covered, because the printing plate is intensively dampened there. The ink and dampening medium equilibrium, however, is established according to the amount of ink transported, since the printing ink absorbs different amounts of dampening medium depending upon the amount of ink transported. However, the more dampening medium penetrating the ink, the more the plate inking is obstructed.

An apparatus for performing the method described above is easily incorporated into the numerical or computer control of a remotely controlled printing machine. A control procedure executed by the computer 31 (FIG. 1) performs the method by controlling the actuators and drives 30, 28, 29, 27 for the metering elements 22, duct roller 23, vibrator 24 and ink applicator rollers 27. A suitable control procedure is represented by the flowchart shown in FIG. 8. In the first step 50, the press drive 25 is turned on but the sheet feed 27 is turned off and inhibited during the pre-adjustment procedure. The ink and dampening applicator rollers 13, 19 are also initially thrown off from the printing plate D of the plate cylinder 11 and the vibrator 24 is initially off. The press drive 25 is turned on since it is presumed that the press drive drives the rollers in the inking unit 12. Next in step 51 the duct roller drive 28 is turned on and set to a prestored speed (SPEED1). In step 52 the ink metering elements 22 are opened to about 60% in anticipation of filling the inking unit 12. In order to fill the inking unit for a prestored time interval (TDUR1), the current time is read in step 54 and in step 55 the time when the filling operation is to stop (FTIME) is computed by adding the predetermined time duration (TDUR1) to the current time (TIME). Preferably, the initial filling operation is completed in not more than twenty-five machine revolutions of the plate cylinder 11. Then in step 56 the vibrator drive 29 is turned on to a prestored speed (SPEED2) so that ink from the ink duct 21 is fed to the rollers of the inking unit 12. To sense the end of the filling operation, the current time (TIME) is periodically read in step 57 and is compared in step 58 to the ending time (FTIME) previously computed in step 55. Once the current time exceeds the ending time, the vibrator is turned off in step 59 and at this point the inking unit 12 has been filled with the base level of ink A. To uniformly distribute this base level of ink A throughout the inking unit, the control procedure waits for a second prestored time duration (TDUR2) before the ink profile P is set and continuous printing is started. In step 60 the current time is read and in step 61 the current time is added to the second time duration (TDUR2) in order to determine the time (FTIME) at which the base level of ink A is uniformly distributed in the inking unit. In step 62 the current time is periodically read and in step 63 compared to the ending time in order to measure out the second time duration (TDUR2).

Now that the base level of ink is uniformly distributed throughout the inking unit 12, the ink metering elements 22 in the ink duct 21 are adjusted to obtain the desired ink profile P. In step 64 the ink metering adjustments for the profile in the presence of dampening are obtained. These ink metering adjustments, for example, are the adjustments last used for the particular printing plate, or are determined in the known fashion by scanning the printing plate or prints produced by the printing plate. During the pre-adjustment operation, however, there is no dampening medium in the inking unit so that in step 65 the ink metering adjustments are reduced to a "no dampening" profile which is predetermined to obrain the desired ink density on the printed sheet even though the dampening medium is absent from the ink ng unit. In step 66 the ink metering elements 22 are adjusted to this reduced profile, and in step 67 the duct roller 23 is turned on and set to its normal speed, as specified by a prestored value (SPEED3).

In order to set up an ink gradient GF through the inking unit 12 corresponding to the gradient for continuous printing, the reduced profile is introduced to the inking unit for a predetermined time duration (TDUR3) just sufficient so that the reduced profile propagates from the ink duct 21 to the ink applicator rollers 13. In step 68 the current time (TIME) is read, and in step 69 the current time is added to the prestored time duration (TDUR3) in order to calculate an ending time (FTIME) for the propagation of the reduced profile. In step 70 the vibrator 24 is turned on to its normal speed (SPEED4) and the current time is then periodically read in step 71 andcompared to the ending time in step 72 to determine when the desired gradient has been established thr-ough the inking unit. Once this gradient is established, the ink applicator rollers 13 and dampening rollers 19 are thrown on to the printing plate D and in step 73 and the sheet feed 27 is turned on in order to start continuous printing. Since dampening medium finds its way into the inking unit 12 after the start of continuous printing, in step 74 the ink metering elements 22 are adjusted to the profile with dampening. Equilibrium is quickly established and the pre-adjustment operation is finished.

In view of theabove, an inking unit pre-adjustment procedure has been described which quickly and reliably brings an inking unit of a printing machine into a state of equilibrium suitable for continuous prinring. The method is easily performed by a computerized press control of the kind currently used for zonal adjustment of the ink metering elements, and manual intervention by the printer is not required.

What is claimed is:

1. For a printing machine having a series of inking unit rollers in an inking unit conveying ink from a source of ink to a printing plate, the source of ink having a plurality of adjustable ink metering elements across the width of the printing machine for regulating respective amounts of ink fed to individual respective printing zones across the width of the printing plate and means for selectively turning on and off the flow of ink from the source of ink to said inking unit rollers, a method of pre-adjusting said inking unit before printing starts prior to continuous printing for which said ink metering elements are adjusted to obtain a desired zonal ink profile based upon the ratio of printing area to total area in each of the zones comprising the steps of adjusting the ink metering elements to regulate approximately the same predetermined amounts of ink, activating said means for selectively turning on and off to turn on the flow of ink form the source of ink to the inking unit rollers, waiting a first predetermined amount of time so that an accurately defined quantity of ink is fed to the inking unit rollers to obtain approximately the same ink thickness on the inking unit rollers that occurs during continuous printing, and then starting continuous printing.

2. The method according to claim 1, wherein said same amount of ink and said first predetermined amount of time are predetermined so that at the end of waiting said first predetermined amount of time, a gradient of ink film thickness is produced on the inking unit rollers in the direction of the ink flow, said gradient being approximately the average value of the gradients occurring at the printing zones across the width of the inking unit during continuous printing, so that when continuous printing starts the ink film thickness distribution in the inking unit quickly approaches the equilibrium ink film thickness distribution during continuous printing.

3. The method according to claim 1, wherein a basic film (A) of substantially uniform thickness is first produced on the inking unit rollers and then ink is superimposed on the basic film (A) corresponding to the gradients (GF) of the ink film thickness occurring in the state of equilibrium obtained during continuous printing.

4. The method according to claim 1, further comprising the step of de-activating said means for selectively turning on and off to turn off the flow of ink from the source of ink to the inking unit rollers after said accurately defined quantity of ink is fed to the inking unit rollers, waiting a second predetermined amount of time for the ink in the inking unit to become uniformly distributed and adjusting the ink metering elements to regulate respective amounts of ink to the individual printing zones in response to the content of the printing plate in the respective printing zones, and activating said means for selectively turning on and off to turn on the flow of ink from the source of ink to the inking unit rollers and waiting a third predetermined amount of time for the respective amounts of ink regulated to the individual printing zones to propagate through the inking unit rollers of the inking unit before starting continuous printing, so that the ink film thickness and gradients through the inking unit rollers for the respective inking zones at the start of continuous printing approximates the equilibrium ink film thickness and gradients through the inking unit rollers during continuous printing.

5. The method according to claim 4, wherein the printing machine is an offset printing press wherein a dampening medium is applied to the printing plate, and wherein the ink metering elements are re-adjusted after the start of continuous printing to compensate for the influx of dampening medium into the inking unit.

6. The method according to claim 4, wherein said printing plate is mounted on a plate cylinder and said first predetermined amount of time is less than the time for twenty-five revolutions of said plate cylinder during continuous printing.

7. The method according to claim 1 wherein said printing plate is mounted to a plate cylinder and said first period of time is less than the time for twenty-five revolutions of said plate cylinder during continuous printing.

8. For rotary printing machine having a plate cylinder carrying a printing plate, an inking unit for receiving ink from an ink duct and applying the ink to the printing plate, the inking unit including a plurality of inking unit rollers including applicator rollers engaging said plate cylinder during continuous printing and means for selectively throwing the applicator rollers on and off the plate cylinder, said ink duct including a duct roller and a plurality of adjustable ink metering elements for regulating respective amounts of ink applied zonally across the surface of said duct roller, said printing machine having a vibrator driven by a vibrator drive to transfer ink from the surface of said duct roller to the inking unit rollers, said adjustable ink metering elements being adjustable to regulate the respective amounts of ink fed to printing zones across said printing plate, said vibrator drive being controllable to turn on and off the flow of ink from the ink duct to the inking unit rollers, and means for driving the inking unit rollers in the absence of continuous printing when the applicator rollers are thrown off the plate cylinder, a method of pre-adjusting the inking unit before printing starts prior to continuous printing for which said ink metering elements are adjusted to obtain a desired zonal ink profile based upon the ratio of printing area to total area in each of the zones comprising the steps of:

initially adjusting the ink metering elements to regulate approximately the same predetermined amounts of ink, controlling said vibrator drive to turn on the flow of ink from the ink duct to the inking unit rollers and driving the inking unit rollers for a first predetermined amount of time in the absence of continuous printing when the applicator rollers are thrown off of the plate cylinder so that an accurately defined quantity of ink is fed to the inking unit rollers approximating the amount of ink stored in the inking unit during continuous printing, and throwing the applicator rollers onto the plate cylinder and starting continuous printing.

9. The method according to claim 8, wherein said same amount of ink and said first predetermined amount of time being predetermined so that at the end of said predetermined amount of time a gradient in ink film thickness is produced on the inking unit rollers in the direction of ink flow, said gradient being approximately the average value of the gradients occurring at the printing zones across the width of the inking unit during continuous printing, so that when continuous printing starts the ink film thickness distribution in the inking unit quickly approaches the equilibrium ink film thickness distribution during continuous printing.

10. The method according to claim 8, wherein a basic ink film (A) of substantially identical thickness throughout is produced on the inking unit rollers and another ink film is produced on the basic film (A) corresponding to the gradients (GF) of the film thickness occurring in the state of equilibrium obtained during continuous printing.

11. The method according to claim 8 wherein the ink metering elements are initially adjusted to a substantially equal metering gap with respect to the duct roller over the length of the duct roller, and before the applicator rollers are thrown onto the plate cylinder, the vibrator drive is controlled to turn off the flow of ink to the inking unit rollers at the end of said first predetermined time interval and the ink metering elements are adjusted to a predetermined profile (P) in the axial direction with respect to the duct roller, said predetermined profile being responsive to the content of the printing plate.

12. The method according to claim 11, wherein the vibrator drive is controlled to turn on the flow of ink to the inking unit rollers at the end of a second predetermined time interval starting at the end of said first predetermined time interval.

13. The method according to claim 11, wherein after the ink metering elements are adjusted to said predetermined profile (P), the vibrator drive is controlled to turn on the flow of ink to the inking unit rollers for a predetermined time interval at the end of which the applicator rollers are thrown onto the plate cylinder and continuous printing is started.

14. The method as claimed in claim 8, wherein all of the ink metering elements are initially adjusted to a metering gap with respect to the duct roller, the said gap being substantially equal over the length of the duct roller; the width of the vibrator strip is set to a defined value; the vibrator is started for said first predetermined amount of time, during which the ink applicator rollers are not thrown onto the plate cylinder; the vibrator is then stopped and the inking unit rollers then continue to run for a second predetermined time interval; during this second predetermined time interval the ink metering elements are adjusted to a required profile (P) in the axial direction with respect to the duct roller, said profile (P) being dependent upon the final print; the vibrator is started for a third predetermined time interval during which the ink applicator rollers are not thrown on the plate cylinder; and after said third predetermined time interval the applicator rollers are thrown onto the plate cylinder and continuous printing is started.

15. The method as claimed in claim 8, wherein said first predetermined amount of time is not more than twenty-five revolutions of the plate cylinder.

16. The method as claimed in claim 8, wherein said printing machine is an offset printing machine having a dampening unit for applying dampening medium to the plate cylinder during continuous printing, and wherein before throwing the applicator rollers onto the plate cylinder and starting continuous printing, the ink metering elements are adjusted to a predetermined initial profile ($P_i$) in the axial direction with respect to the duct roller, said predetermined profile being responsive to the content of the printing plate and being predetermined so that the applicator rollers apply a thickness of ink to the plate cylinder at the start of printing approximating the equilibrium thickness during continuous printing and said ink metering elements are readjusted after the start of printing to a different profile ($P_f$), said initial profile ($P_i$) being predetermined in consideration of the fact that the inking unit is initially free of dampening medium, and said different profile ($P_f$) being predetermined in consideration of the fact that some dampening medium flows into the inking unit during continuous printing.

17. A method of pre-adjusting the inking unit of a rotary printing machine of the kind having an ink duct including a duct roller and a plurality of zonal ink metering elements along the length of the duct roller for setting up an ink profile on the duct roller, a vibrator for transferring the ink profile from the duct roller to the inking unit, the inking unit having applicator rollers for engagement with a plate cylinder carrying a printing plate and a plurality of other inking unit rollers for receiving the ink profile from the vibrator and transferring the ink profile to the applicator rollers and the printing plate during continuous printing, the ink metering elements being remotely adjustable by an ink control computer, the vibrator being driven by a vibrator drive controllable by said computer to turn on and off the vibrator and the flow of ink to the inking unit rollers, the applicator rollers having a throw-off mechanism controllable by said computer to throw the applicator rollers onto and off of the plate cylinder, said inking unit rollers capable of being driven when the applicator rollers are thrown on as well as off of the plate cylinder, said computer executing a predetermined procedure to perform said method of pre-adjusting the inking unit comprising the steps of:

(1) adjusting said ink metering elements to set up a substantially uniform first ink profile along the length of the duct roller, (2) turning on said vibrator and driving said inking unit rollers with the applicator rollers thrown off of the plate cylinder for a predetermined time period selected in accordance with said first ink profile and the ink capacity of said inking unit so that the inking unit is filled at the end of said first predetermined period with an amount of ink approximately equal to the base level of ink in said inking unit when equilibrium is established during continuous printing, (3) turning off said vibrator and so that the ink in the inking unit to become substantially uniformly distributed among the inking unit rollers, (4) adjusting the ink metering elements to set up a second ink profile along the length of the duct roller responsive to the content of the printing plate, and when the ink in the inking unit is substantially uniformly distributed, turning on the vibrator for a predetermined time period sufficient for the second ink profile to propagate to the applicator rollers and when the ink profile substantially reaches the applicator rollers throwing the applicator rollers onto the plate cylinder and starting continuous printing.

18. The method as claimed in claim 17, wherein the printing machine is an offset printing machine including a dampening unit applying dampening fluid to the printing plate, and wherein after continuous printing is started the ink metering elements are readjusted to compensate for the influx of dampening fluid into the inking unit.

* * * * *